US009413073B2

(12) United States Patent
Milroy et al.

(10) Patent No.: US 9,413,073 B2
(45) Date of Patent: Aug. 9, 2016

(54) AUGMENTED E-PLANE TAPER TECHNIQUES IN VARIABLE INCLINATION CONTINUOUS TRANSVERSE (VICTS) ANTENNAS

(71) Applicant: ThinKom Solutions, Inc., Torrance, CA (US)

(72) Inventors: William Milroy, Torrance, CA (US); James Sor, San Pedro, CA (US); Eugene Yum, Los Angeles, CA (US)

(73) Assignee: ThinKom Solutions, Inc., Hawthorne, CA (US)

( * ) Notice: Subject to any disclaimer, the term of this patent is extended or adjusted under 35 U.S.C. 154(b) by 63 days.

(21) Appl. No.: 14/581,026

(22) Filed: Dec. 23, 2014

(65) Prior Publication Data

US 2016/0181700 A1 Jun. 23, 2016

(51) Int. Cl.

| | |
|---|---|
| ***H01Q 13/00*** | (2006.01) |
| ***H01Q 3/00*** | (2006.01) |
| ***H01Q 11/02*** | (2006.01) |
| ***H01Q 21/30*** | (2006.01) |

(52) U.S. Cl.
CPC ..... *H01Q 11/02* (2013.01); *H01Q 21/30* (2013.01)

(58) Field of Classification Search
CPC ..... H01Q 11/02; H01Q 13/00; H01Q 3/00; H01Q 3/16
See application file for complete search history.

(56) References Cited

U.S. PATENT DOCUMENTS

| | | | | |
|---|---|---|---|---|
| 5,266,961 | A | 11/1993 | Milroy | |
| 5,483,248 | A * | 1/1996 | Milroy | H01Q 13/28 343/767 |
| 5,583,524 | A * | 12/1996 | Milroy | H01Q 13/28 343/767 |
| 6,894,654 | B2 | 5/2005 | Lynch | |
| 7,388,551 | B2 * | 6/2008 | Guidon | H01Q 21/005 343/754 |
| 7,432,871 | B2 * | 10/2008 | Milroy | H01Q 21/0031 343/771 |
| 2004/0233117 | A1 | 11/2004 | Milroy et al. | |
| 2006/0267850 | A1 | 11/2006 | Krikorian et al. | |
| 2012/0177376 | A1 | 7/2012 | Chang et al. | |
| 2015/0171515 | A1 * | 6/2015 | Milroy | H01Q 3/04 343/756 |

OTHER PUBLICATIONS

Extended European Search Report dated Apr. 29, 2016 for corresponding European Application No. 15201921.2.

* cited by examiner

*Primary Examiner* — Hoang V Nguyen
(74) *Attorney, Agent, or Firm* — Renner, Otto, Boisselle & Sklar, LLP

(57) ABSTRACT

An antenna array employing continuous transverse stubs as radiating elements includes a first conductive plate structure including a first set of continuous transverse stubs arranged on a first surface, and a second set of continuous transverse stubs arranged on the first surface, wherein a geometry of the first set of continuous transverse stubs is different from a geometry of the second set of continuous transverse stubs. A second conductive plate structure is disposed in a spaced relationship relative to the first conductive plate structure, the second conductive plate structure having a surface parallel to the first surface. A relative rotation apparatus imparts relative rotational movement between the first conductive plate structure and the second conductive plate structure.

12 Claims, 15 Drawing Sheets

FIG. 2A
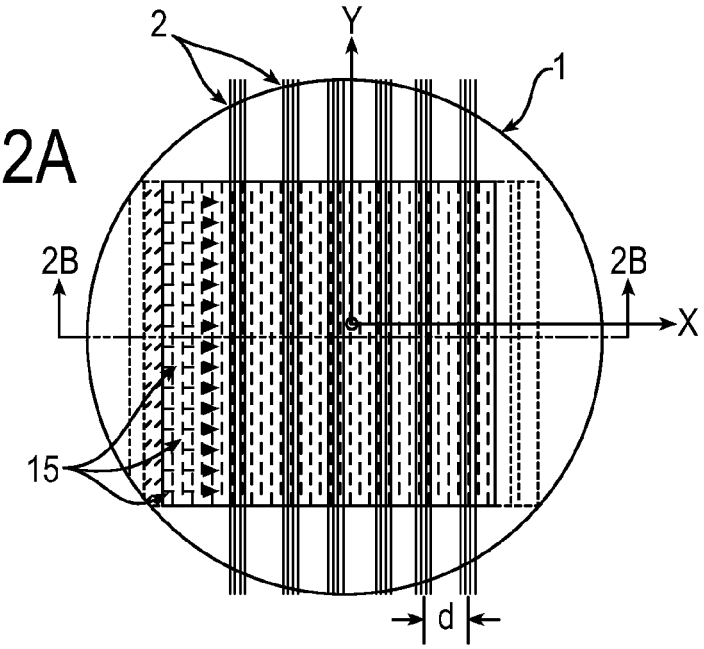
FIG. 2B
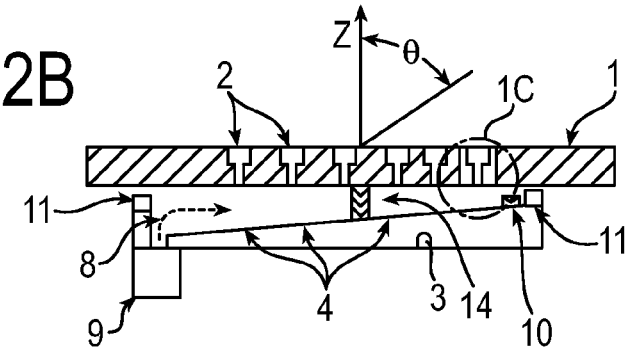
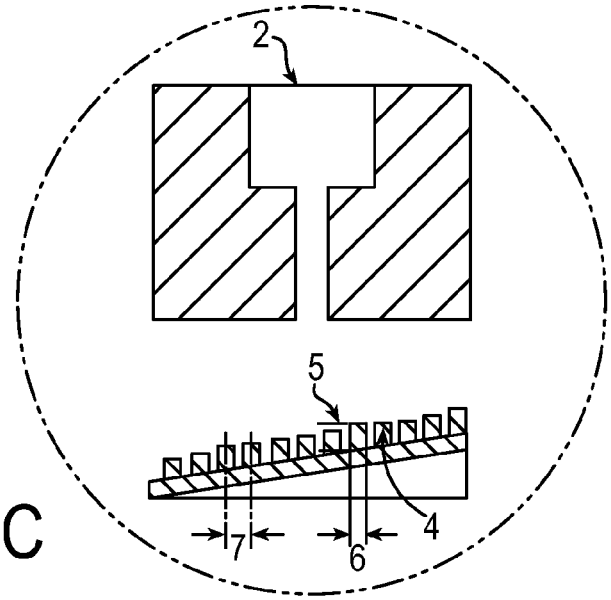
FIG. 2C

FIG. 2D
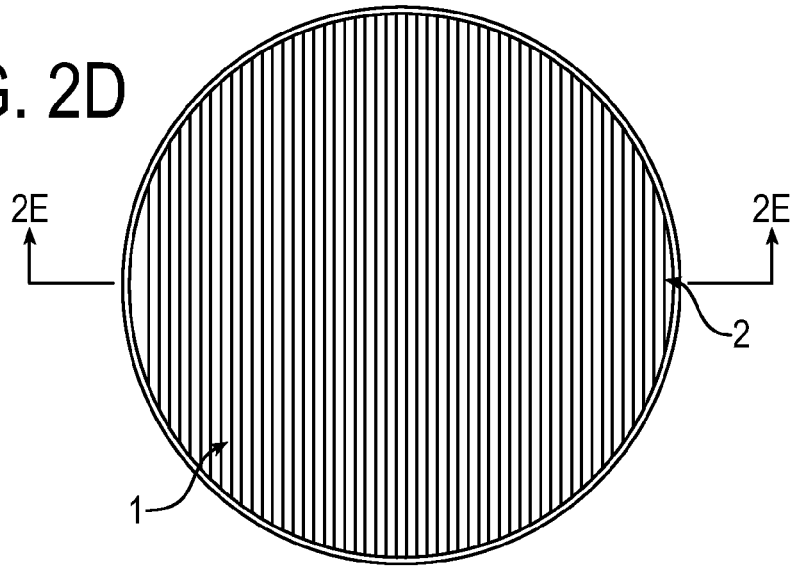
FIG. 2E
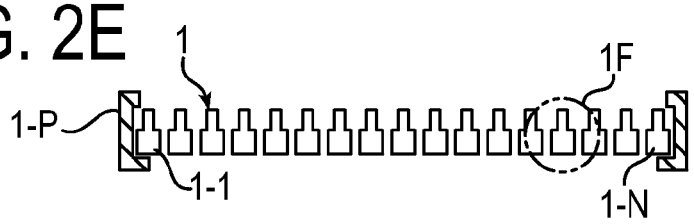
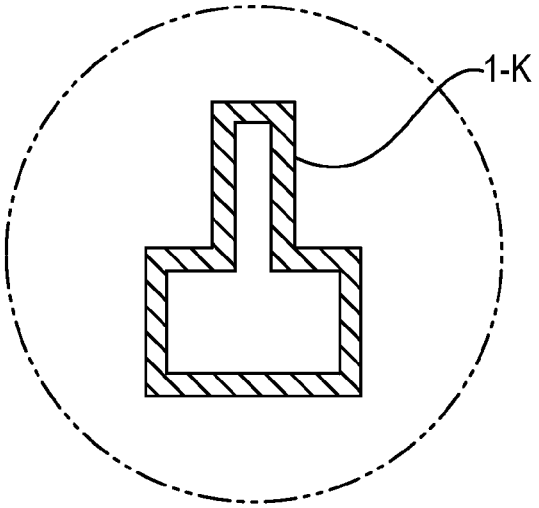
FIG. 2F

FIG. 3A
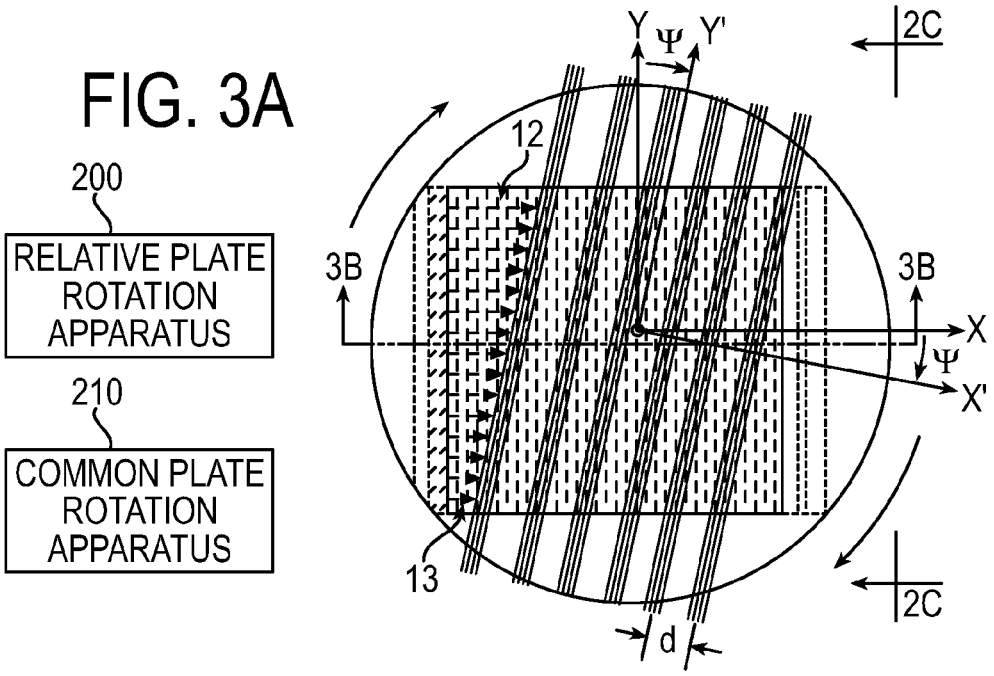
FIG. 3B
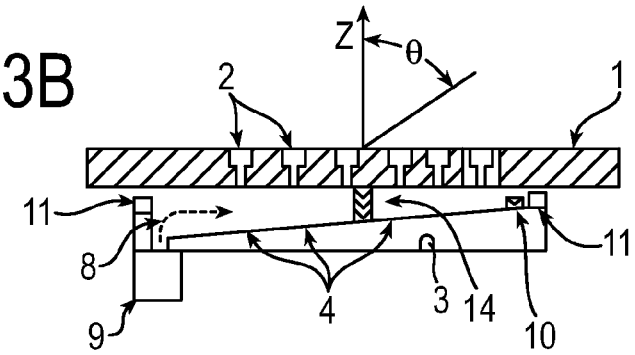
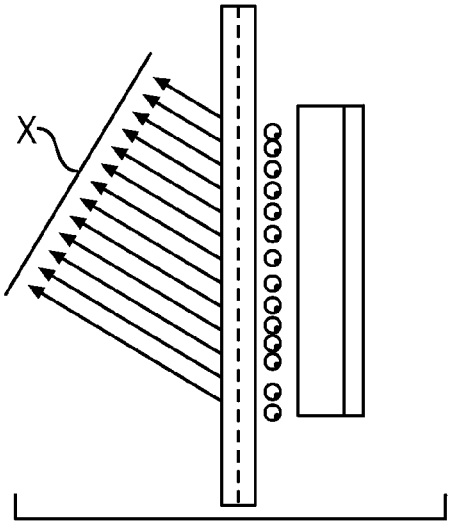
FIG. 3C

| b1 OPENING | SLL (1ST ADJACENT) | SLL (FAR OUT IMPROVEMENT) |
|---|---|---|
| 50-MILS (NOMINAL) | -15dB | NOMINAL @ -33dB DOWN |
| 40-MILS | -17.3dB | -35dB DOWN |
| 30-MILS | -20.6dB | -36dB DOWN |
| 20-MILS | -24.8dB | -37dB DOWN |
| 10-MILS | -21.5dB | -37dB DOWN |

FIG. 10a

AUGMENTED E-PLANE TAPER TECHNIQUES IN VARIABLE INCLINATION CONTINUOUS TRANSVERSE (VICTS) ANTENNAS

TECHNICAL FIELD

The present disclosure relates generally to antennas and, more particularly, to an apparatus and method for increasing the available radiating element coupling range realizable for a traveling-wave fed leaky-wave antenna array.

BACKGROUND ART

Many antenna applications require a conformal (thin) mechanical profile that provides directive beams (high-gain, narrow beamwidth) that can be selectively steered over a pseudo-hemispherical scan volume. Such low-profile two-dimensionally scanned antennas are generically referred to as phased arrays in that the angle between the electromagnetic phase-front and the mechanical normal of the array can be selectively varied in two-dimensions. Conventional phased arrays include a fully-populated lattice of discrete phase-shifters or transmit-receive elements each requiring their own individual phase-control and/or power-control lines.

The recurring costs (component, assembly, and test), prime power, and cooling requirements associated with such electronically controlled phased arrays can be prohibitive in many applications. In addition, such conventional arrays can suffer from degraded ohmic efficiency (peak gain), poor scan efficiency (gain roll-off with scan), limited instantaneous bandwidth (data rates), and data stream discontinuities (signal blanking between commanded scan positions). These cost and performance issues can be particularly pronounced for physically large and/or high-frequency arrays where the overall phase-shift/transmit-receive module count can exceed many thousands of elements.

Variable inclination continuous transverse stub (VICTS) antennas are a different class of antennas that provide the beam steering capabilities of much more expensive electronically scanned phased arrays, but without the need for expensive phase shifters. VICTS antennas are fundamentally traveling wave antennas that mechanically rotate concentric platters (plates) to achieve scanning in the elevation plane.

Since the circular platters rotate about a physical center of the antenna, the aperture extrusions that define the continuous transverse stub (CTS) radiators in the antenna are traditionally designed with identical radiators to enable a symmetric cross section about the rotational center of the antenna. The use of identical radiators helps to reduce production/integration costs and also simplifies the RF modeling analysis.

With the radiator dimensions constrained to be uniformly identical, variable coupling (in order to realize a desired antenna pattern characteristic) is typically achieved via variation of the parallel-plate spacing (the variable air-gap region between the upper and lower platters between which the bounded propagating RF energy travels as it is coupled and subsequently radiated by the stub radiators.) Intentional variation of local parallel-plate spacing immediately below each (fixed geometry) radiating stub allows for customization of the resultant coupling and radiation of RF energy from the common parallel-plate region below. Smaller parallel-spacing (smaller "gaps") lead to higher coupling whereas larger spacings lead to lower coupling values. It is generally desirable to maximize this dynamic range (ratio of highest coupling to lowest coupling) so as to provide the greatest flexibility in realizing desired antenna pattern characteristics, including beamwidth and sidelobe levels.

Mechanical (and electrical) constraints on the practical range (maximum and minimum) of parallel plate spacing, when paired together with the identical radiator element constraint, limit the achievable coupling range that can be realized in typical array embodiments. This ultimately limits the sidelobe profiles that can be realized thereby limiting the desirable suppression of adjacent satellite interference (ASI) levels and capping the maximum permitted power spectral density (PSD) of a given antenna size when employed in typical satellite communication applications.

VICTS E-Plane taper (sidelobe performance) design is heavily dependent on the available range of coupling one can achieve via variation in the spacing within the parallel plate region. The VICTS antenna designer is limited to a range of coupling values by both mechanical and electrical considerations (constraints).

From an electrical standpoint, setting the parallel plate height too high can introduce unwanted RF moding effects, reducing efficiency, and limiting achievable aperture (sidelobe) tapers as illustrated in FIG. 1. More particularly, FIG. 1 illustrates a CTS radiator 2 having a first (incoming) port P1, a second (outgoing) port P2, a third (coupled) port P3, and separated parallel plates 1 and 3 with associated parallel plate spacing "s". As can be seen in the graph of FIG. 1, for a given parallel plate spacing "s", increasing frequency (and correspondingly smaller wavelengths) lead to undesired variability (significant reduction) in the coupling value (|S13|) as the electrical size of "s" approaches a value of one-half-wavelength ($\lambda_d/2$), in this particular example at a frequency of approximately 14.1 GHz. This upper-limit threshold is associated with the presence of undesired multiple modes which propagate between the plates. Shown in the graph of FIG. 1 are |S11| (i.e., the energy reflected back to port 1), |S21| (i.e., the energy transmitted from port 1 to port 2) and |S31| (the energy from port 1 coupled and subsequently radiated through port 3).

From a mechanical standpoint, setting the parallel plate height (spacing) too shallow can lead to undesirable coupling sensitivity to small mechanical variations. Any undesired mechanical tolerance or vibration driven change in parallel-plate spacing, expressed as a percentage of nominal spacing, can become very large (resulting in a correspondingly large undesired variation in coupling) as the nominal parallel-plate spacing varies.

The aforementioned electrical and mechanical factors typically constrain the achievable coupling (maximum versus minimum) via intentional variation in parallel plate spacing to approximately a 6 dB to 7 dB range, thereby restricting the achievable aperture excitation tapers (antenna radiation pattern characteristics) one can design in the plane orthogonal to the radiating stubs (the E-plane.) The H-plane taper is controlled by the feed distribution and is not subject to either of these inhibitors.

SUMMARY OF INVENTION

An apparatus and method in accordance with the present disclosure improves the radiating element coupling range achievable in a VICTS E-Plane design (or other waveguide-fed antenna) with minimal increase in the manufacturing cost or integration complexity. The approach in accordance with the present disclosure enhances the coupling range by utilizing a small number of dissimilar radiators rather than requiring all radiators to be strictly identical. This can be achieved by modifying the first few radiators (located closest to the feed/launch location, 8-12 elements typically) to narrow the coupling gap between adjacent radiators relative to the remaining radiators (i.e., the air gap between radiators), thereby broadening the achievable coupling window (lower limit on achievable coupling value.) Conversely, similar improvement could be realized on the high coupling side (upper limit on achievable coupling value) by increasing (opening up) the dimension between adjacent radiators.

According to one aspect of the invention, a fundamentally traveling wave antenna includes: a first conductive plate structure having a first surface; a second conductive plate structure disposed in a spaced relationship relative to the first conductive plate structure, the second conductive plate structure having a second surface parallel to the first surface, wherein a primary transmission line of the antenna is formed between the first and second conductive plate structures; a first set of continuous transverse stub (CTS) radiators arranged on the first surface, the first set of CTS radiators having a first opening coupling the main transmission line to a free space over both the first and second conductive plate structures; a second set of CTS radiators arranged on the first surface, the second set of CTS radiators having a second opening coupling the main transmission line to the free space, wherein a width of the first opening is different from a width of the second opening.

In one embodiment, the antenna includes a third set of CTS radiators arranged on the first surface, the third set of CTS radiators having a third opening coupling the main transmission line to the free space, wherein a width of the third opening is different from a width of the first and second openings.

In one embodiment, a centerline-to-centerline spacing between the first set of CTS radiators is equal to a centerline-to-centerline spacing between the second set of CTS radiators.

In one embodiment, the first set of CTS radiators is formed from first plurality of extrusions arrayed serially in a one-dimensional array, and the second set of CTS radiators is formed from a second plurality of extrusions arrayed serially in a one-dimensional array, wherein at least one dimension of the first plurality of extrusions is different from a corresponding dimension of the second plurality of extrusions.

In one embodiment, the second set of CTS radiators is arranged at an inner or outer perimeter of the first conductive plate.

In one embodiment, the antenna includes a relative rotation apparatus operative to impart relative rotational movement between the first conductive plate structure and the second conductive plate structure.

In one embodiment, the antenna includes a feed network for transmitting or receiving a signal to or from the first conductive plate, wherein the relative rotation apparatus is operative to rotate the first plate to position one of the first set of CTS radiators or the second set of CTS radiators into proximity of the feed network.

In one embodiment, the antenna comprises a variable inclination continuous transverse stub (VICTS) antenna array.

In one embodiment, a coupling range in an E-plane of the VICTS array is greater than 7 dB.

According to another aspect of the invention, a method is provided for increasing E-Plane taper in a fundamentally traveling wave antenna having a parallel plate structure defining a main transmission line of the antenna, and a free space above the parallel plate structure. The method includes: receiving a signal via the parallel plate structure defining; coupling at least a first portion of the received signal to the free space via a first set of continuous transverse stub (CTS) radiators, the first set of CTS radiators having a first opening coupling the primary transmission line to the free space; coupling at least a second portion of the received signal to the free space via a second set of continuous transverse stub (CTS) radiators, the second set of CTS radiators having a second opening coupling the primary transmission line to the free space, wherein at least one dimension of the first opening is different from the corresponding dimension of the second opening.

In one embodiment, the method includes coupling at least a third portion of the received signal to the free space via a third set of continuous transverse stub (CTS) radiators, the third set of CTS radiators having a third opening coupling the primary transmission line to the free space, wherein at least one dimension of the third opening is different from the corresponding dimension of the first and second opening.

In one embodiment, the method includes using a VICTS antenna as the fundamentally traveling wave antenna.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, like references indicate like parts or features.

FIG. 2A is a top view of a portion of an exemplary VICTS array.

FIG. 2B is a simplified cross-sectional view taken along line 2B-2B of FIG. 2A.

FIG. 2C is an enlargement of a portion of the embodiment illustrated in FIG. 2B.

FIG. 2D is a top view of an alternate embodiment of a VICTS array employing an extrusion-based upper plate.

FIG. 2E is a cross-sectional view taken along line 2E-2E of FIG. 2D.

FIG. 2F is an enlargement of a portion of the embodiment illustrated in FIG. 2E.

FIG. 3A is a top view similar to FIG. 2A, but with the upper plate rotated relative to the bottom plate.

FIG. 3B is a cross-sectional view taken along line 3-3B of FIG. 3A.

FIG. 3C illustrates the radiated electromagnetic phase front resulting from the antenna orientation of FIG. 3A.

FIG. 10*a* is a table characterizing improvement in first adjacent sidelobe level (SLL) as well in the nominal far-out SLL levels vs. opening for an antenna in accordance with the present disclosure.

DETAILED DESCRIPTION OF INVENTION

Figure 1:
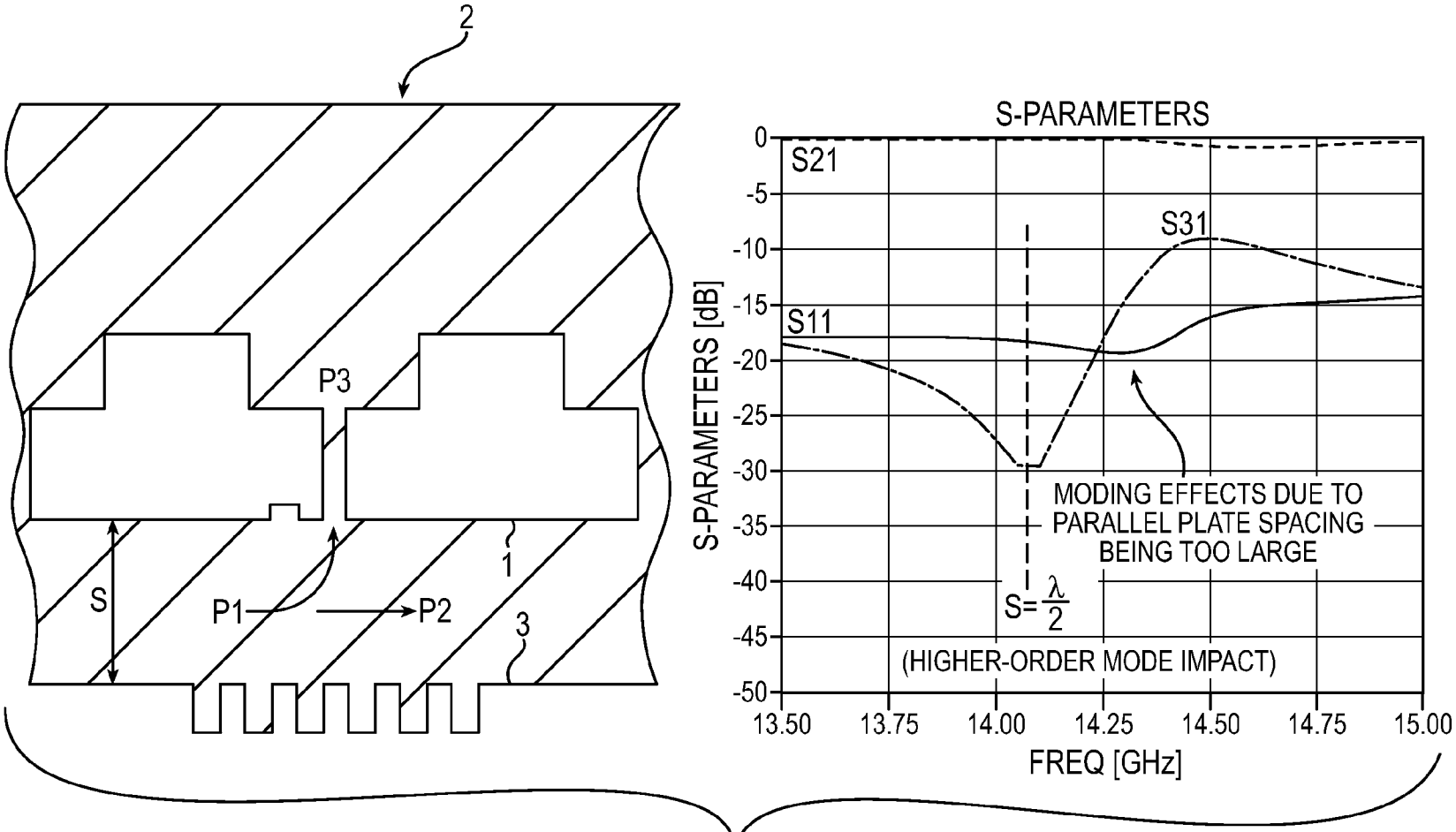
FIG. 1 illustrates a unit cell cross-section of a single CTS radiator element, and a graph illustrating the onset of moding effects due to parallel plate spacing.

A VICTS antenna array typically includes two plates, one (upper) having a one-dimensional lattice of CTS radiators and the second (lower) having one or more line sources emanating into the parallel-plate region formed and bounded between the upper and lower plates. Mechanical rotation of the upper plate relative to the lower plate serves to vary the inclination of incident parallel-plate modes, launched at the line source(s), relative to the CTS radiators in the upper plate, and in doing so constructively excites a radiated planar phase-front whose angle relative to the mechanical normal of the array ($\theta$) is a simple continuous function of the relative angle ($\psi$) of (differential) mechanical rotation between the two plates. Common rotation of the two plates in unison moves the phase-front in the orthogonal azimuth ($\phi$) direction.

Accordingly, the radiating stub aperture of the conventional VICTS antenna is comprised of a collection of identical, parallel, uniformly-spaced (centerline-to-centerline) CTS radiators over its entire surface area with a uniform fixed air gap between adjacent extrusions. The radiating stub aperture serves to couple energy from a parallel-plate region, which is formed between the upper-most conductive surface of the array network and the lower-most conductive surface of the radiating stub aperture structure.

A VICTS array in accordance with the present disclosure employs an additional (different) radiating stub geometry that can vary from the primary stub geometry, for example, while the centerline-to-centerline spacing between CTS radiators remains constant. More particularly, an opening between adjacent CTS radiators varies over part or all of the radiating aperture. In this regard, CTS radiators can be formed by arraying extrusions serially in a one-dimensional array, whereby an opening or "air gap" between a first pair or group of extrusions is different than an opening between a next pair or group of extrusions. In practice, regions of common air gap are grouped into a finite number of sets or regions (generally 2 or more.)

Referring now to FIG. 2A, an exemplary variable inclination continuous transverse stub (VICTS) array is illustrated in a rectangular X, Y, Z coordinate frame of reference. FIG. 2A is a top view of a conductive upper plate 1 and a lower conductive plate 3, shown disposed in a plane parallel to the X-Y plane. The upper plate 1 contains a set of identical, equally spaced, Continuous Transverse Stub (CTS) radiators 2. CTS radiators are well known in the art, e.g., U.S. Pat. Nos. 5,349,363 and 5,266,961, which are hereby incorporated by reference in their entirety. Note that a total of six (6) CTS radiators are shown as an example, although upper plates 1 containing more CTS radiators, or alternatively less CTS radiators may be deployed.

FIG. 2B is a cross-sectional view taken along line 2B-2B of FIG. 2A, showing in cross-section the upper plate 1 and lower conductive plate 3. FIG. 2C is an enlarged view of a portion of FIG. 2B. The lower conductive plate 3 is made in such a way that its cross-section varies in height in the positive z-direction as a function of x-coordinate as shown. Both plates are located in X, Y, Z space in such a way that they are centered about the z-axis. An optional dielectric support 14 is disposed along the z-axis and acts as a support between the upper and lower plates.

The top surface of the lower plate 3 contains a number of rectangular shaped corrugations 4 with variable height 5, width 6, and centerline-to-centerline spacing 7. As shown in FIG. 2C, the corrugations 4 may, in some embodiments, be disposed with constant cross-section over the full length of the lower plate 3 in the y-direction, though they are typically variable (non-uniform).

The lower surface of plate 1 and the upper corrugated surface of plate 3 form a quasi-parallel plate transmission line structure that possesses plate separation that varies with the x-coordinate. The transmission line structure is therefore periodically loaded with multiple impedance stage CTS radiating stubs 2 that are contained in plate 1. Further, plate 1 along with the upper surface of plate 3 form a series-fed CTS radiating array, where the parallel plate spacing varies in one dimension and corrugations are employed to create an artificial dielectric or slow-wave structure.

The upper plate 1, shown in FIG. 2B as being fabricated from a solid conductive plate, can take different forms. For example, as shown in FIGS. 2D-2F, the upper plate can be fabricated as a set of closely spaced extrusions 1-1 to 1-N, with typical extrusion 1-K shown in the enlarged cross-sectional view of FIG. 2F, held together by a conductive or non-conductive frame 1-P.

The CTS array may be excited from below at one end 8 by a generic linear source 9 (also referred to as a feed network). Traveling-waves consisting of parallel-plate modes are created by the source between the lower surface of the upper plate and the upper surface of the lower plate. These modes propagate in the positive x-direction. Plane wave-fronts associated with these modes are contained in planes parallel to the Y-Z plane. Dotted arrows, 15, indicate the direction of rays associated with these modes, as launched into the parallel-plate region via the linear source 9, in a direction perpendicular to the Y-Z plane.

As the traveling-waves propagate in the positive x-direction away from the linear source 9, corresponding longitudinal surface currents flow on the lower surface of the upper plate 1 and the upper surface of the lower plate 3 and corrugations in the positive x-direction. The currents flowing in the upper plate 1 are periodically interrupted by the presence of the CTS radiator elements 2. As such, separate traveling waves are coupled into each CTS radiator element that travel in the positive z-direction to the top surface of the upper plate 1 and radiate into free space at the terminus of the uppermost impedance stage.

The collective energy radiated from all the CTS radiator elements 2 causes an antenna pattern to be formed far away from the upper surface of the upper plate 1. The antenna pattern will show regions of constructive and destructive interference or side lobes and a main beam of the collective waves and is dependent upon the frequency of excitation of the waves and geometry of the CTS array. The radiated signal will possess linear polarization with a very high level of purity. The CTS radiator centerline-to-centerline spacing, d, and corrugation dimensions 5, 6, and 7 (FIG. 2C), may be selected such that the main beam is shifted slightly with respect to the mechanical bore sight of the antenna defined by the z-axis.

Any energy not radiated into free space will dissipate in an RF energy-absorbing load 10 placed after the final CTS radiator in the positive x-direction. Non-contacting frictionless RF chokes, 11, placed before the generic linear source (negative x-direction) and after the RF energy-absorbing load (positive x-direction) prevent unwanted spurious radiation of RF energy.

If the upper plate 1 is rotated or inclined in a plane parallel to the X-Y plane as shown in FIG. 3A by some angle ψ, the effect of such a rotation is that the orientation of the CTS radiators 2 relative to the fixed incident waves emanating from the source is modified. As the waves travel away from the source towards the CTS radiators 2, rays incident upon the CTS radiators towards the top 12, (positive y-coordinate) of the parallel plate region arrive later in time than rays incident towards the bottom 13 of the parallel plate region (negative y-coordinate). Consequently, waves coupled from the parallel plate region to the CTS radiators 2 will possess a linear progressive phase factor along their length parallel to Y' and a smaller linear progressive phase factor perpendicular to their length along the X' axis. These two linear phase factors cause the radiated planar phase front (FIG. 3C) from the antenna to make an angle with the mechanical bore sight (along the z-axis) of the antenna that is dependent on ψ. This leads to an antenna pattern whose main beam is shifted or scanned in space.

The amount of change in the linear progressive phase factors and correspondingly the amount of scan increases with increasing ψ. Further, both plates 1 and 3 may be rotated simultaneously to scan the antenna beam in azimuth. Overall, the antenna beam may be scanned in elevation angle, θ, from zero to ninety degrees and in azimuth angle, ψ, from zero to three hundred and sixty degrees through the differential and common rotation of plates 1 and 3 respectively. Moreover, the antenna beam may be continuously scanned in azimuth in a repeating three hundred and sixty-degree cycle through the continuous rotation of plates 1 and 3 simultaneously.

In general the required rotations for a VICTS array may-be achieved through various means illustrated schematically in FIG. 3A as relative plate rotation apparatus 200 and common plate rotation apparatus 210, including but not limited to being belt driven, perimeter gear driven, or direct gear driven.

Thus, a CTS antenna provides a relatively thin, two dimensionally scanned phased array antenna. This is accomplished through a unique variable phase feeding system whose incident phase fronts are fixed while scanning is achieved by mechanically inclining (rotating) a set of CTS radiators 2.

As plate 1 is rotated with respect to plate 3, the relative positions of all the CTS radiators 2 will change in such a way that the parallel plate separation for a given CTS radiator 2 will be different than that at zero degrees rotation. Moreover the parallel plate separation will vary as a function of both X and Y. Since the effective coupling factor, $K_2$, is designed to be mostly constant with respect to rotation angle and varies only with plate separation, the overall coupling profile and corresponding amplitude distribution of the antenna will be mostly constant with respect to rotation angle. In this manner, the amplitude distribution is synthesized solely through the variation of the parallel plate separation in lieu of variations in the radiating stub dimensions.

Figure 4:
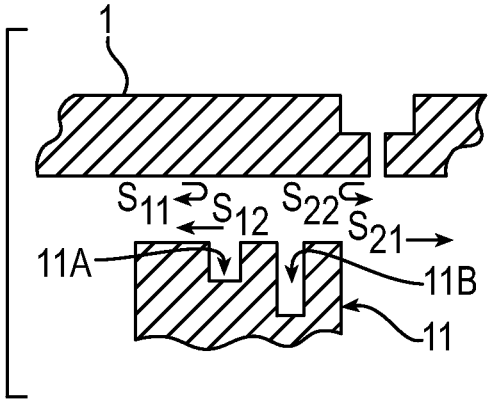
FIG. 4 illustrates a non-contacting choke utilized with CTS stubs for the embodiment of FIGS. 2A-3C.

As illustrated in FIGS. 3 and 4, a choke mechanism 11 can be deployed to prevent spurious RF energy from escaping outside the physical boundaries of the antenna. An exemplary choke embodiment is shown in FIG. 4. In this embodiment, a coupled pair of CTS radiators 11A, 11B are deployed. |S11| and |S22| represent reflected waves and are ideally high (close to unity) for an ideal choke, indicating that all RF energy encroaching on the "protected/isolated" choke region (from either direction) is completely reflected. |S12| and |S21| represent the transmission (undesired "leakage") through the choke region and are ideally zero. In practice, the choke presents an extremely high impedance to any waves incident in the choke region such that $S_{11}$ and $S_{22}$ have magnitudes very close to one and $S_{12}$ and $S_{21}$ have magnitudes very close to zero. The choke provides good RF choking regardless of rotation angle and the choke performance may be designed to be virtually invariant with rotation angle over a given frequency range.

Figure 5A:
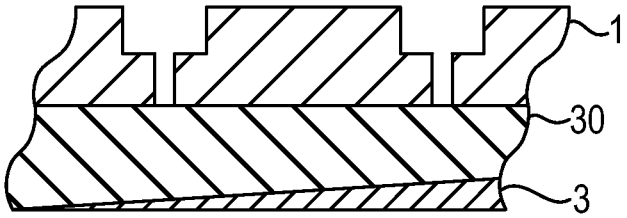
FIGS. 5A-5E depict alternative structures for achieving the dielectric constant between the plates 1 and 2.
Figure 5B:
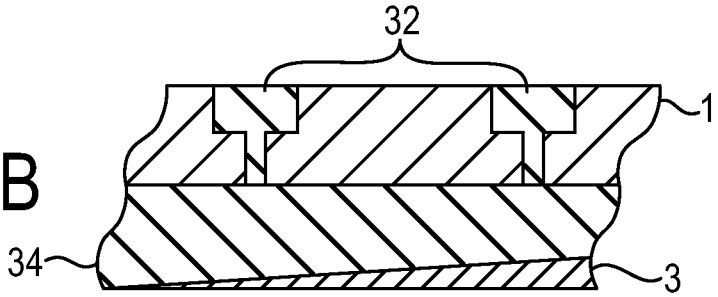
Figure 5C:
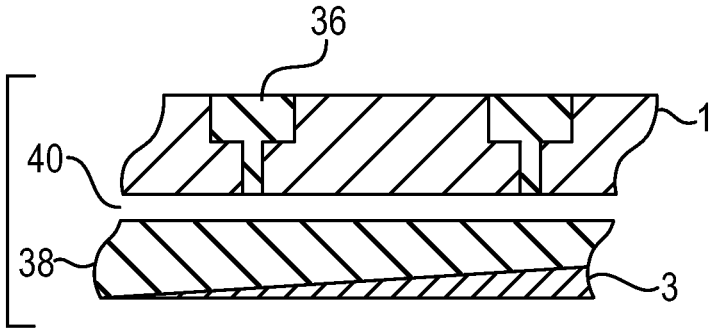
Figure 5D:
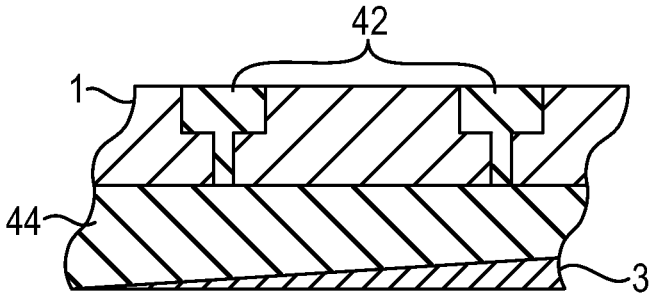
Figure 5E:
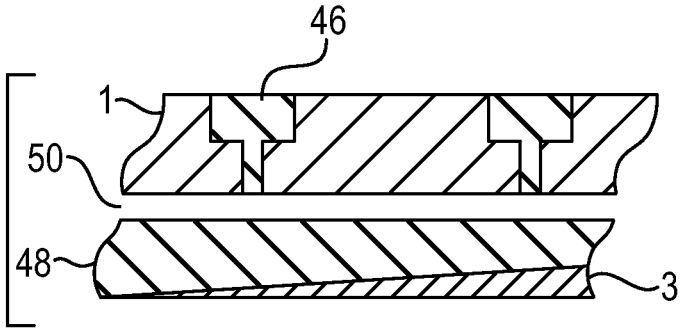

Alternative techniques may be used to load the region between the plates 1 and 3. FIGS. 5A-E show cut-away views in which a solid dielectric 30 is arranged in the parallel plate region (FIG. 5A), separate identical solid dielectrics 32, 34 is arranged in the radiator and the plate regions (FIG. 5B), separate identical solid dielectrics 36, 38 is arranged in the radiator and the plate region with a gap 40 (FIG. 5C), separate non-identical solid dielectrics 42, 44 is arranged in the CTS radiator and the plate region (FIG. 5D), and separate non-identical solid dielectrics 46, 48 is arranged in the CTS radiator and the plate region with a gap 50 (FIG. 5E). Other geometries are possible and may be useful for certain applications. Additional details concerning a VICTS array can be found in U.S. Pat. No. 6,919,854 issued to Milroy, the contents of which is hereby incorporated by reference in its entirety.

Figure 6:
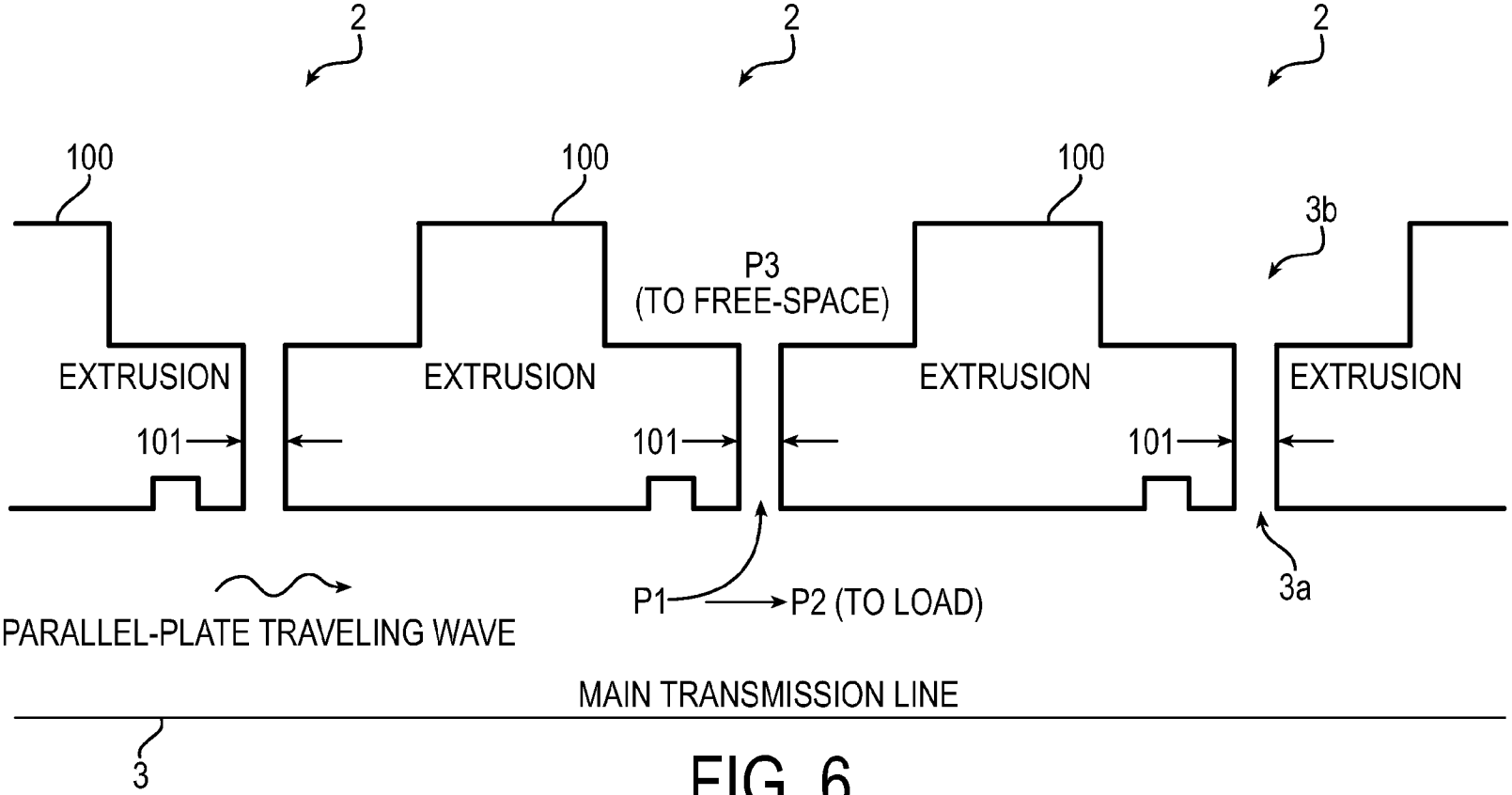
FIG. 6 illustrates parallel plate cross-section showing formation of CTS radiators by arraying extrusions serially in a one-dimensional array in accordance with the present disclosure.
Figure 7:
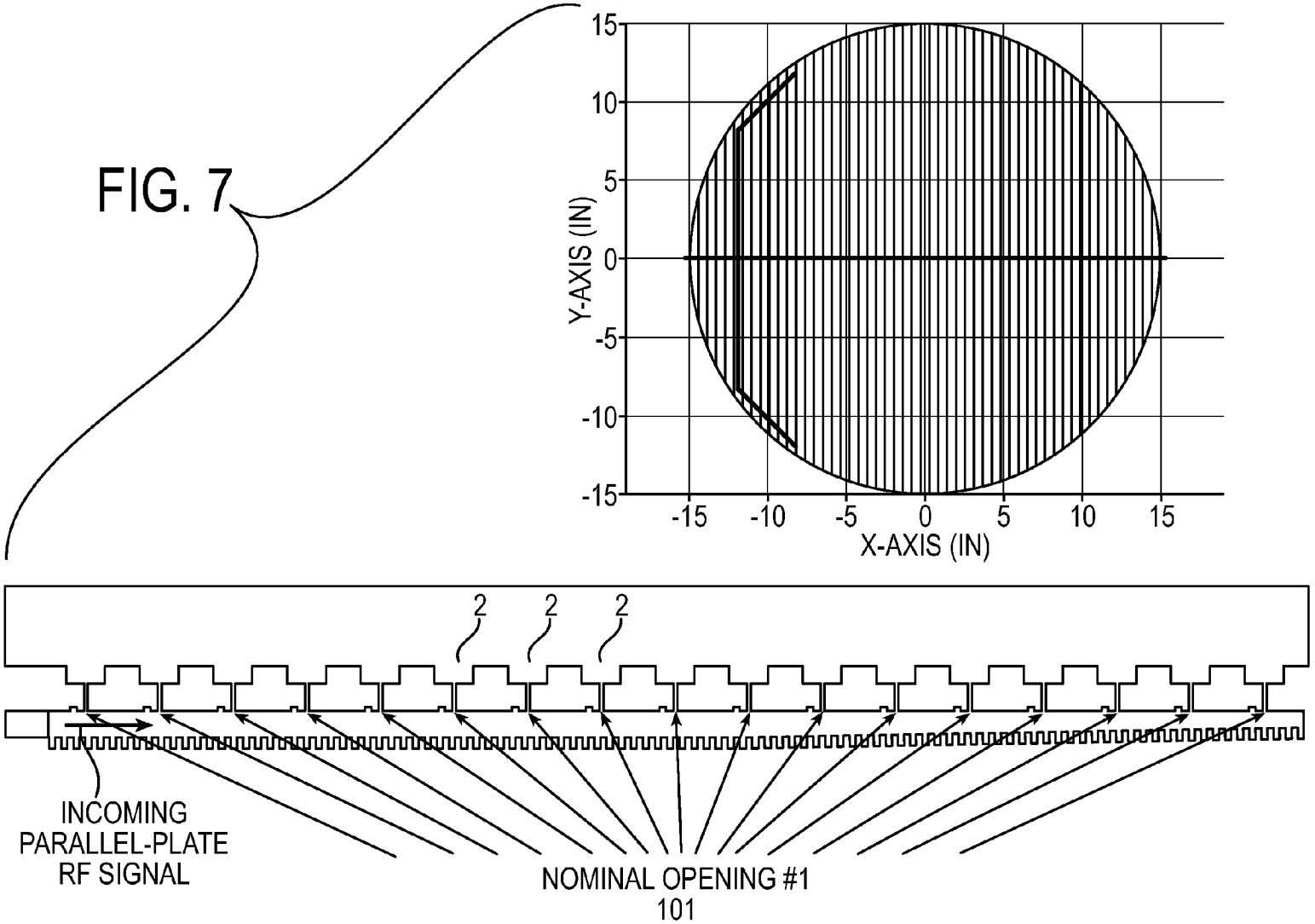
FIG. 7 illustrates VICTS E-Plane Traveling Wave Cross Section (Nominal).

With reference to FIGS. 6 and 7, conventional CTS/VICTS radiators 2 are formed utilizing identical extrusions 100, which lead to identical radiating elements aside from parallel plate depths. An incoming parallel-plate RF signal (launched from the generic feed structure 9) propagates from left-to-right in the illustrated structure. Each CTS radiator 2 includes a first stage 3*a* defined by the opening between adjacent extrusions 100, and a second stage 3*b* defined by the space above the extrusions 100, the first stage 3*a* coupling the main transmission line to the second stage 3*b*. As can be seen in FIGS. 6 and 7, the use of identical extrusions 100 results in an opening 101 between adjacent CTS radiators (the width of the first stage 3*a*) that remains substantially the same for each radiator pair/group.

Figure 8:
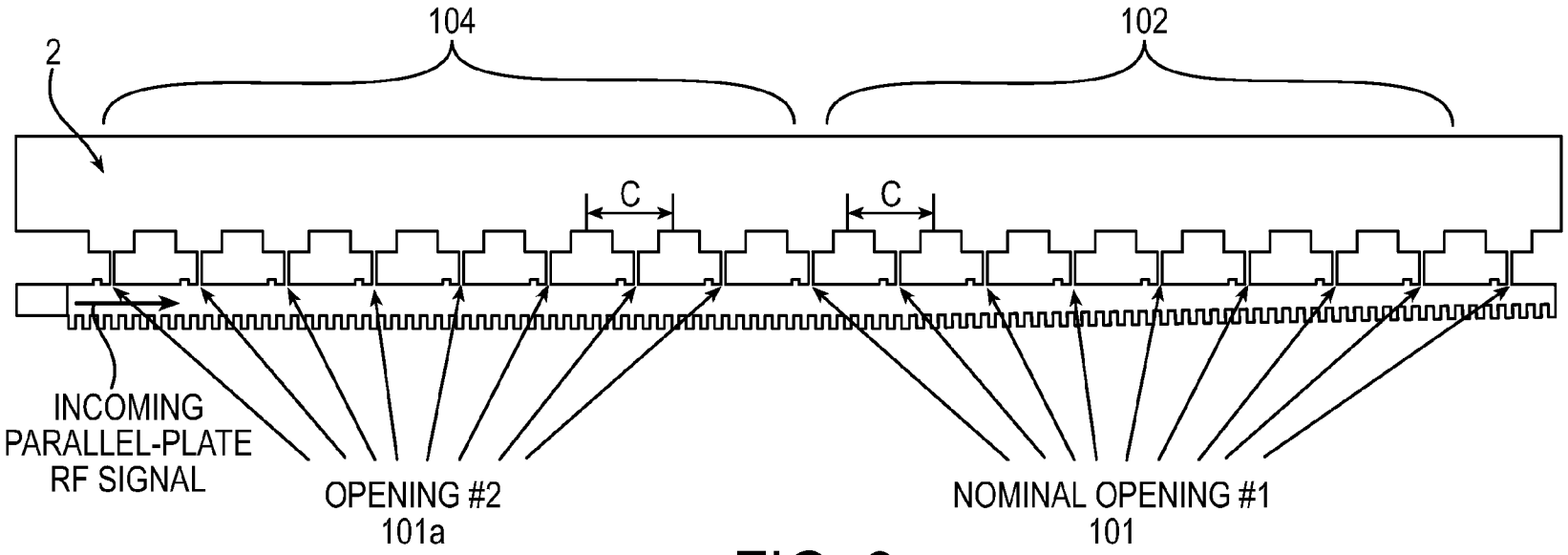
FIG. 8 illustrates VICTS E-Plane Traveling Wave Cross Section (2 Extrusion Set) in accordance with the present disclosure.

In accordance with the present disclosure, at least some CTS radiators 2 are formed from non-uniform extrusions having a constant centerline-to-centerline spacing C, thereby providing different opening between adjacent CTS radiators. With reference to FIG. 8, illustrated is an exemplary parallel plate cross-section showing formation of CTS radiators 2 from two different extrusions. The radiators 2 are formed by arraying extrusions serially in a one-dimensional array, where the extrusions that form the CTS radiators 2 are dimensioned such that the opening 101*a* for CTS radiators formed from a first extrusion is different from the opening 101 of CTS radiators formed from a second extrusion. A centerline-to-centerline distance C between adjacent extrusions within a group (and thus the CTS radiators), however, remains constant. This results in an opening (air gap) 101*a* between a first set of radiators 104 formed using the first extrusion being different from an opening (air gap) 101 between a second set of radiators 102 formed from the second extrusion. The center-to-center spacing C of the extrusions remains the same.

Figure 9:
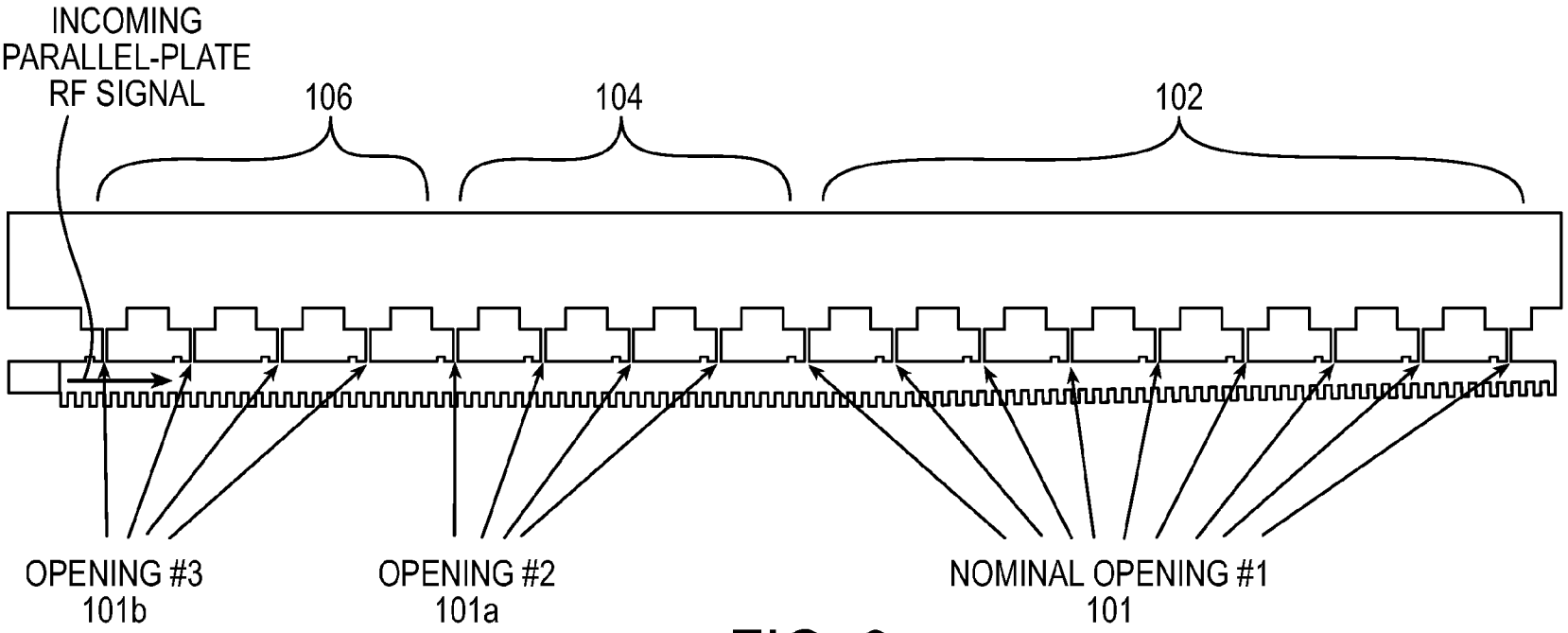
FIG. 9 illustrates VICTS E-Plane Traveling Wave Cross Section (3 Extrusion Set) in accordance with the present disclosure.

FIG. 9 illustrates another embodiment that is similar to the embodiment shown in FIG. 8. However, instead of forming the CTS radiators 2 from two different extrusions, the radiators in the embodiment of FIG. 9 are formed using three different extrusions. This results in a first set of radiators 106 having a first opening 101*b*, a second set of radiators 104 having a second opening 101*a*, and a third set of radiators 102 having a third opening 101, where the first, second and third openings are dimensionally different from one another (e.g., some are wider than others).

By introducing different openings in CTS radiators, performance of the antenna is enhanced. This is illustrated in FIGS. 10*a*-13*b*, which show performance gains due to varying the opening size.

FIG. 10*a* is a table showing predicted pattern improvement due to the formation of CTS radiators 2 using different extrusions in accordance with the present disclosure. More particularly, the table of FIG. 10*a* illustrates the different levels of improvement in the first adjacent sidelobe level (SLL) as well as the nominal far-out SLL relative to the dimension of the opening (101*a*) for the first section of extrusions of a two extrusion configuration for a particular VICTS antenna. As shown in FIG. 10*a*, as the opening is constricted, the sidelobe is reduced. In the exemplary embodiment, optimum SLL and far-out SLL are achieved using an opening (width) of 20-mils.

Figure 10B:
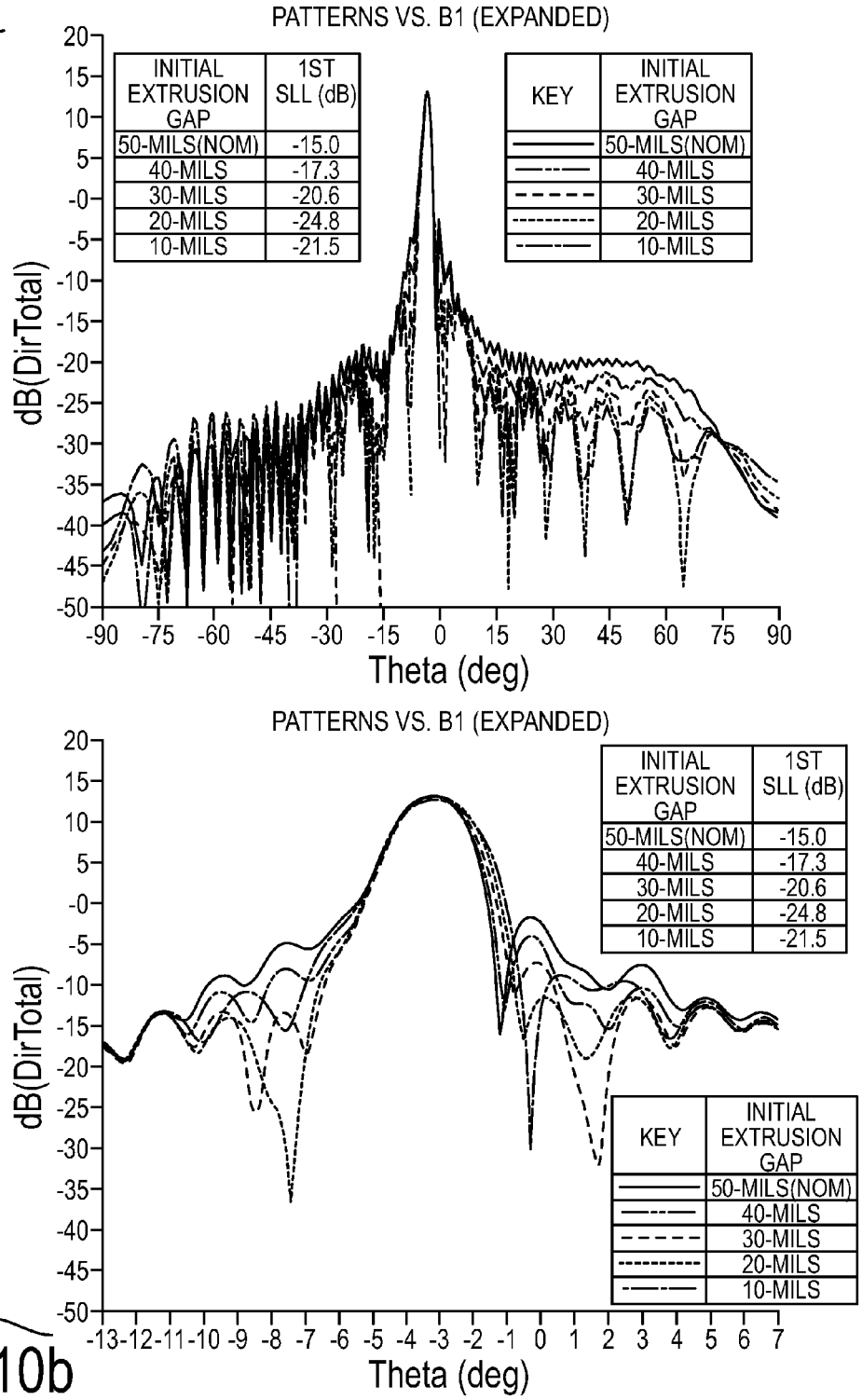
FIG. 10*b* illustrates an expanded (left) and zoomed (right) pattern cuts taken along VICTS E-Plane while varying the opening for an antenna in accordance with the present disclosure.

FIG. 10*b* is an antenna pattern produced from the radiating structure of FIG. 8 (two extrusion configuration), and includes two graphs for the HFSS (high frequency structure simulator) predicted pattern improvement for an antenna incorporating features in accordance with the present disclosure. More particularly, FIG. 10*b* illustrates antenna pattern cuts, one expanded (left) and the other zoomed (right), taken along the VICTS E-plane. The varied parameter is the opening 101*a* between adjacent CTS radiators 2 (which is made smaller by widening the extrusions). As the spacing is decreased the sidelobes become lower, which can reduce interference with adjacent satellites.

Figure 11:
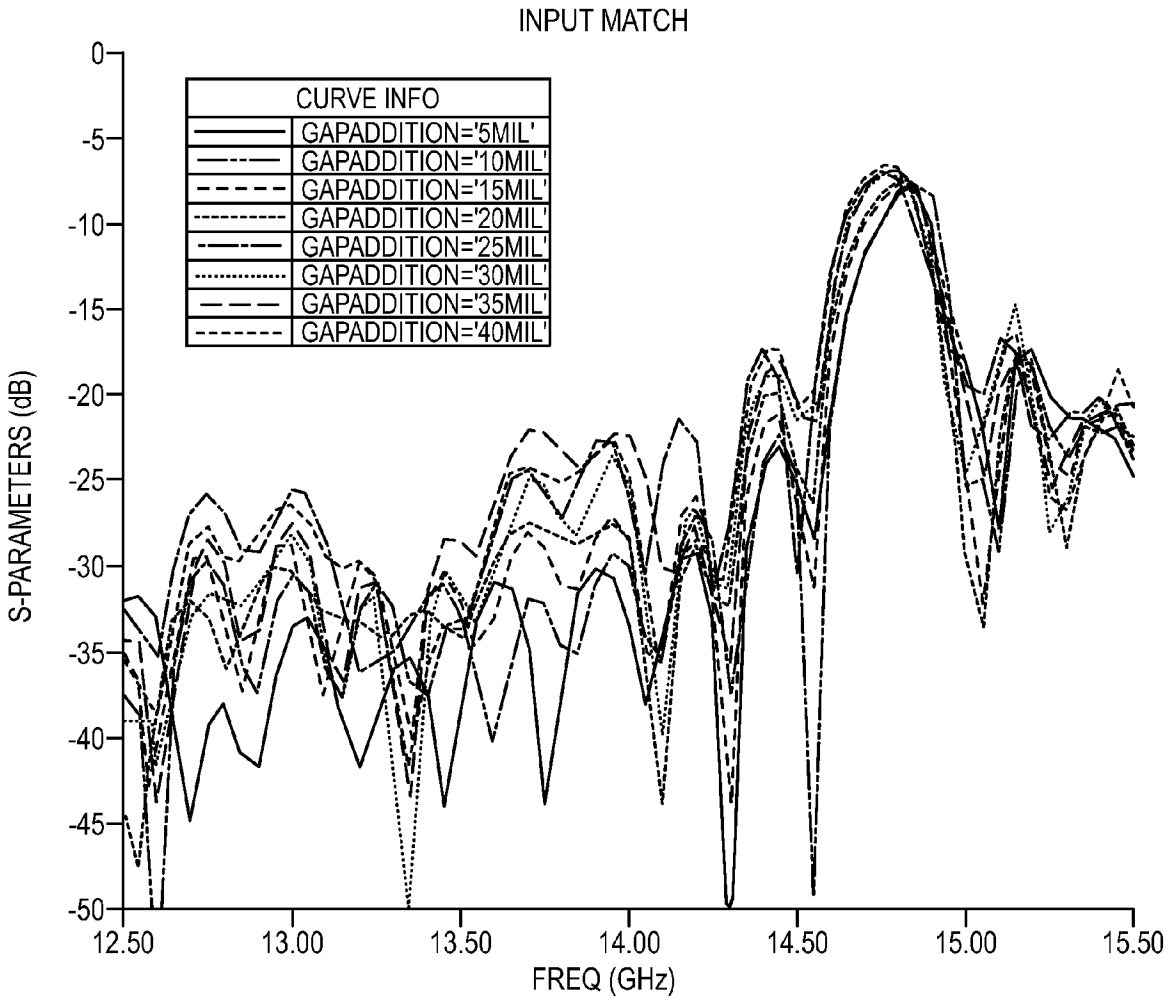
FIG. 11 is a graph showing the |S11| (Input Match) impact over a wide range of openings for the two-extrusion configuration for an antenna in accordance with the present disclosure.

FIG. 11 is a graph illustrating the HFSS predicted |S11| scattering parameter (reflection coefficient). In particular, the graph shows the |S11| impact over a wide range of openings 101*a* for the two-extrusion configuration. While the opening size is changing, |S11| remains well-behaved (favorably low in magnitude) and the impact on antenna match is negligible. Note the |S11| bump at ~14.8 GHz is due to the antenna operating at $\psi=0$, where all internal reflections add up, and not due to E-Plane taper enhancements.

Figure 12:
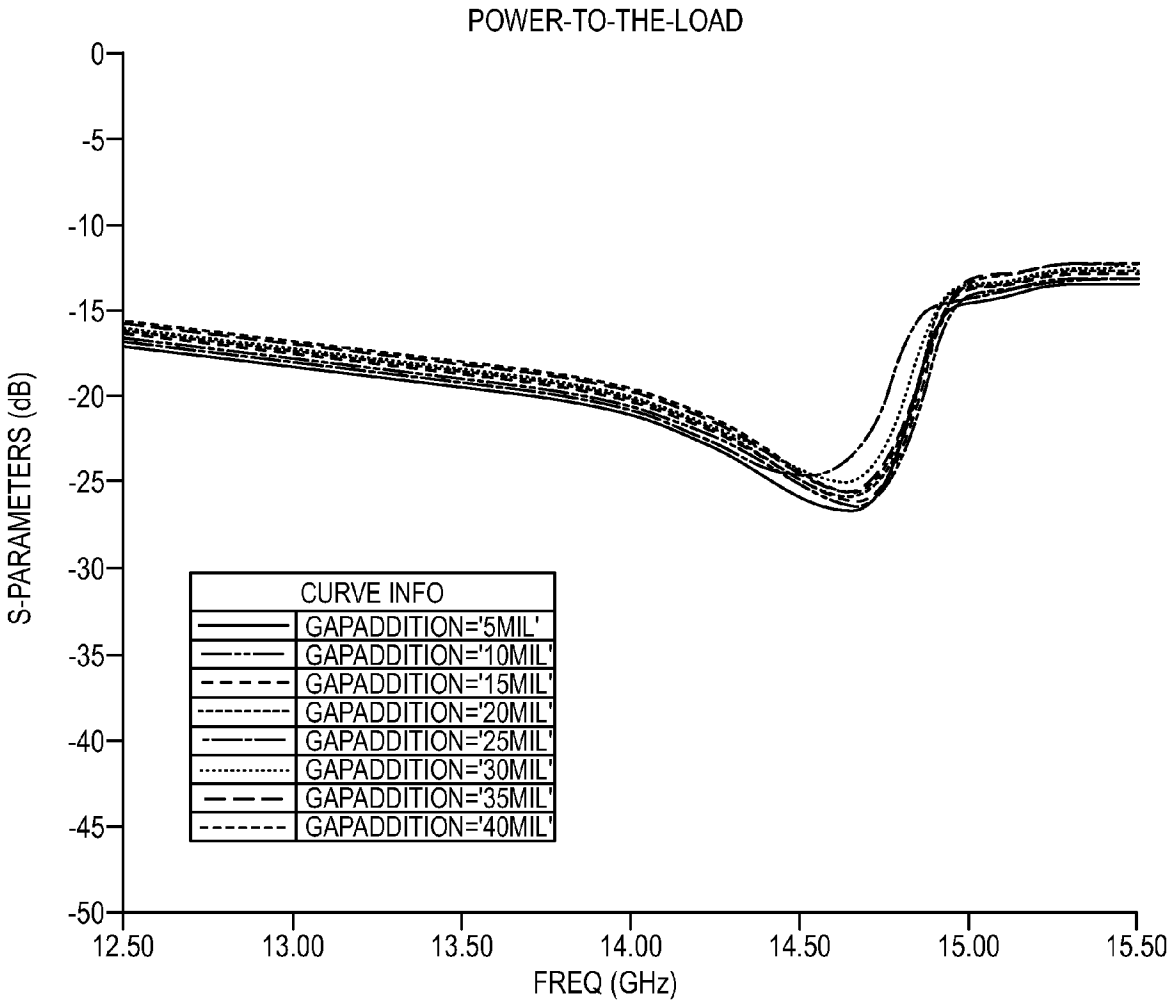
FIG. 12 illustrates the impact on the power dumped to the load |S21| is negligible over a wide range of openings for a two-extrusion antenna in accordance with the present disclosure.

FIG. 12 is a graph showing the HFSS power to load |S21| for the two-extrusion configuration. As can be seen in FIG. 12, over the operating range of the antenna (i.e., 14.5 GHz and lower), the impact on the power transmitted from port 1 to port 2 (S21—the power dumped to the load) is negligible over a wide range of openings 101*a*.

Figure 13:
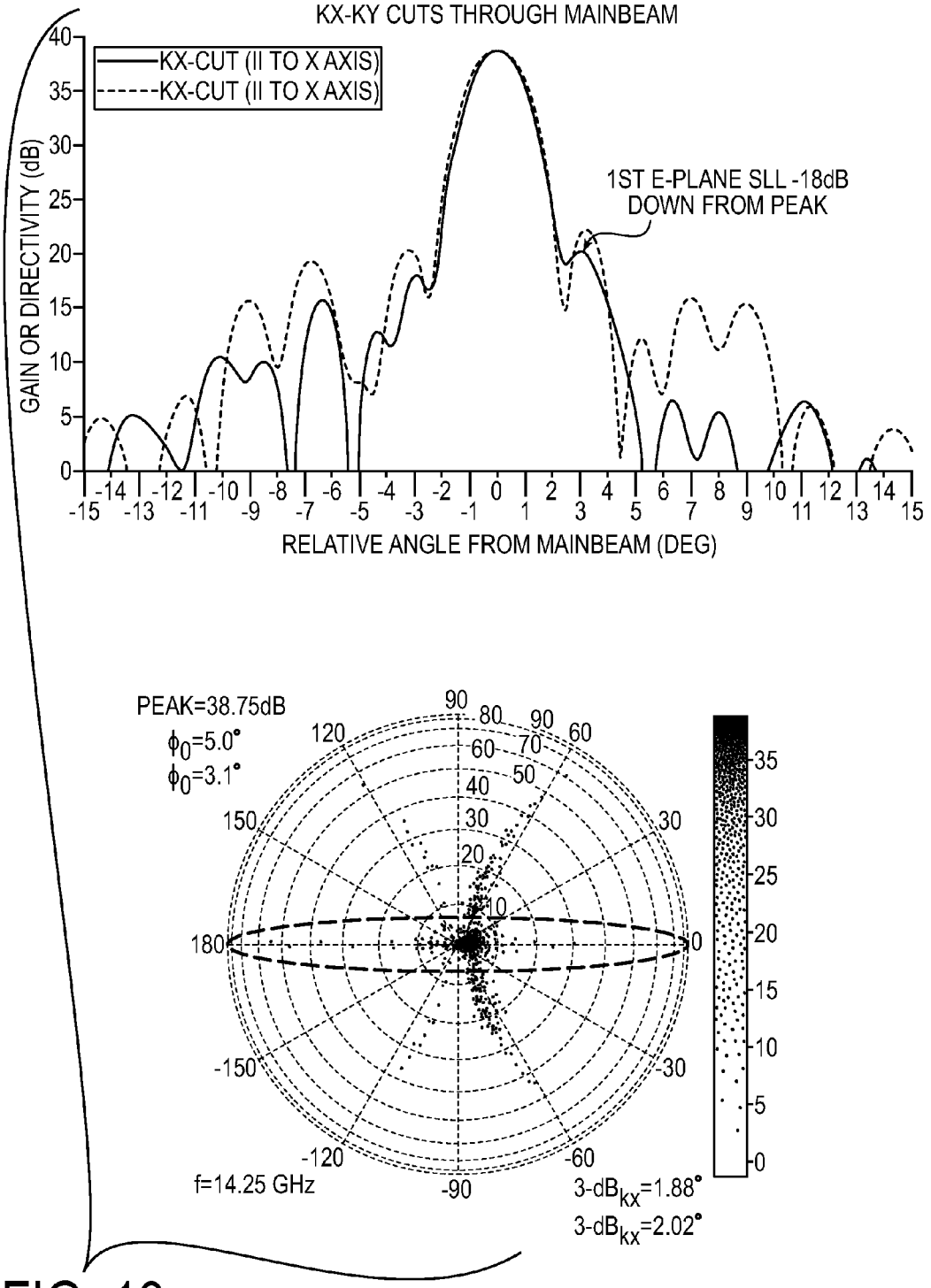
FIG. 13 illustrates E-Plane sidelobe enhancement on VICTS antenna using enhanced taper E-Plane (two-extrusion Design) in accordance with the present disclosure.

FIG. 13 is an actual measurement obtained from a prototype antenna and illustrates pattern quality improvement for an antenna employing aspects in accordance with the present disclosure. Specifically, an enhanced (lower) E-Plane sidelobe level ("kx-cut') for a particular embodiment employing a two-extrusion design in accordance with the present disclosure, is shown. The first E-plane SLL is shown to be favorably suppressed to a level of −18 dB from the main beam peak as compared to a typical −12 dB to −15 dB value for a conventional (uniform extrusion) embodiment. Thus, by varying the opening of the first stage of at least some CTS radiators 2 in accordance with the present disclosure, sidelobes are reduced (−3 dB to −6 dB in the present example) and thus performance is enhanced.

The dynamic coupling range in CTS/VICTS designs is normally limited by RF moding concerns and mechanical robustness constraints. Such limitations can be overcome using the teachings provided herein, and can enhance the achievable dynamic coupling range available in the E-plane of a VICTS or CTS antenna. This enables the antenna designer to achieve antennas with more refined E-plane pattern tapers and better overall sidelobe control.

Further, enhanced coupling and improved pattern taper can be achieved without any appreciable impact to other antenna performance characteristics, including VSWR and power-to-the-load. Both VSWR and power-to-the-load remain comparable to the nominal of a conventional VICTS antenna.

Finally, measured results show that the sidelobe artifact trail associated with the n=0 grating lobe located outside visible space has been noticeably dampened compared to designs using uniformly identical radiators. This sidelobe trail can beat (coherently/constructively add) with the "blow-thru" (undesired direct-radiation leakage of the feed through the CTS element proximal to the feed point) associated with the first CTS element and has in the past significantly limited antenna pattern quality and associated Tx PSD performance. Measured data confirms that the principles in accordance with the present disclosure improve suppression of the sidelobe trail, particularly at the first sidelobe level, and the intended reduction in coupling for the elements closest to the feed favorably reduces the "blow-thru" contribution.

Principles in accordance with the present disclosure can be augmented to existing VICTS designs in many forms without much added complexity. Examples for two-extrusion and three-extrusion variations have been described, and the concept can be extended to almost limitless variations depending on desired taper control and complexity tradeoff.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

What is claimed is:

1. A fundamentally traveling wave antenna, comprising:

a first conductive plate structure having a first surface;

a second conductive plate structure disposed in a spaced relationship relative to the first conductive plate structure, the second conductive plate structure having a second surface parallel to the first surface, wherein a primary transmission line of the antenna is formed between the first and second conductive plate structures;

a first set of continuous transverse stub (CTS) radiators arranged on the first surface, the first set of CTS radiators having a first opening coupling the main transmission line to a free space over both the first and second conductive plate structures;

a second set of CTS radiators arranged on the first surface, the second set of CTS radiators having a second opening coupling the main transmission line to the free space, wherein a width of the first opening is different from a width of the second opening.

2. The antenna according to claim 1, further comprising a third set of CTS radiators arranged on the first surface, the third set of CTS radiators having a third opening coupling the main transmission line to the free space, wherein a width of the third opening is different from a width of the first and second openings.

3. The antenna according to claim 1, wherein a centerline-to-centerline spacing between the first set of CTS radiators is equal to a centerline-to-centerline spacing between the second set of CTS radiators.

4. The antenna according to claim 1, wherein the first set of CTS radiators is formed from first plurality of extrusions arrayed serially in a one-dimensional array, and the second set of CTS radiators is formed from a second plurality of extrusions arrayed serially in a one-dimensional array, wherein at least one dimension of the first plurality of extrusions is different from a corresponding dimension of the second plurality of extrusions.

5. The antenna according to claim 1, wherein the second set of CTS radiators is arranged at an inner or outer perimeter of the first conductive plate.

6. The antenna according to claim 1, further comprising a relative rotation apparatus operative to impart relative rotational movement between the first conductive plate structure and the second conductive plate structure.

7. The antenna according to claim 6, further comprising a feed network for transmitting or receiving a signal to or from the first conductive plate, wherein the relative rotation apparatus is operative to rotate the first plate to position one of the first set of CTS radiators or the second set of CTS radiators into proximity of the feed network.

8. The antenna according to claim 1, wherein the antenna comprises a variable inclination continuous transverse stub (VICTS) antenna array.

9. The antenna according to claim 8, wherein a coupling range in an E-plane of the VICTS array is greater than 7 dB.

10. A method for increasing E-Plane taper in a fundamentally traveling wave antenna having a parallel plate structure defining a main transmission line of the antenna, and a free space above the parallel plate structure, the method comprising:

receiving a signal via the parallel plate structure defining;

coupling at least a first portion of the received signal to the free space via a first set of continuous transverse stub (CTS) radiators, the first set of CTS radiators having a first opening coupling the primary transmission line to the free space;

coupling at least a second portion of the received signal to the free space via a second set of continuous transverse stub (CTS) radiators, the second set of CTS radiators having a second opening coupling the primary transmission line to the free space, wherein at least one dimension of the first opening is different from the corresponding dimension of the second opening.

11. The method according to claim 10, further comprising coupling at least a third portion of the received signal to the free space via a third set of continuous transverse stub (CTS) radiators, the third set of CTS radiators having a third opening coupling the primary transmission line to the free space, wherein at least one dimension of the third opening is different from the corresponding dimension of the first and second opening.

12. The method according to claim 10, further comprising using a VICTS antenna as the fundamentally traveling wave antenna.

* * * * *